United States Patent [19]

Sanjana

[11] 3,934,249

[45] Jan. 20, 1976

[54] BORDER FLASHERS

[75] Inventor: James Sanjana, Mississauga, Canada

[73] Assignee: Lawrence Peska Associates, Inc., New York, N.Y. ; a part interest

[22] Filed: Mar. 13, 1974

[21] Appl. No.: 450,737

[52] U.S. Cl. ..... 340/340; 340/379

[51] Int. Cl.[2] ..... G09F 13/00

[58] Field of Search ..... 340/324 R, 325, 378 R, 340/379, 334, 336, 339, 340; 250/213 A, 206

[56] References Cited

UNITED STATES PATENTS

| | | | |
|---|---|---|---|
| 1,920,229 | 8/1933 | Wright | 340/334 |
| 3,222,527 | 12/1965 | Low et al. | 250/213 A |
| 3,432,846 | 3/1969 | Jones et al. | 340/339 |
| 3,555,351 | 1/1971 | Sherwin | 340/339 |
| 3,569,778 | 3/1971 | Leverte | 340/339 |
| 3,710,379 | 1/1973 | Bruinsma | 340/379 |
| 3,813,539 | 5/1974 | Sioma | 250/213 A |

*Primary Examiner*—Marshall M. Curtis

[57] ABSTRACT

An improved border lamp flasher device employing electronic circuitry by which lamps are switched on and off in such a way as to make it appear as if the lamps are circulating around the border of a sign, marquee or the like, or an attention getter advertising display. It omits any electro-mechanical switching means, using only solid-state circuits of the sub-miniature integrated circuit type, which are becoming increasingly inexpensive as mass production and ultimate industrial use increases. This eliminates sparking contacts which have had considerable damaging effects on television reception.

6 Claims, 1 Drawing Figure

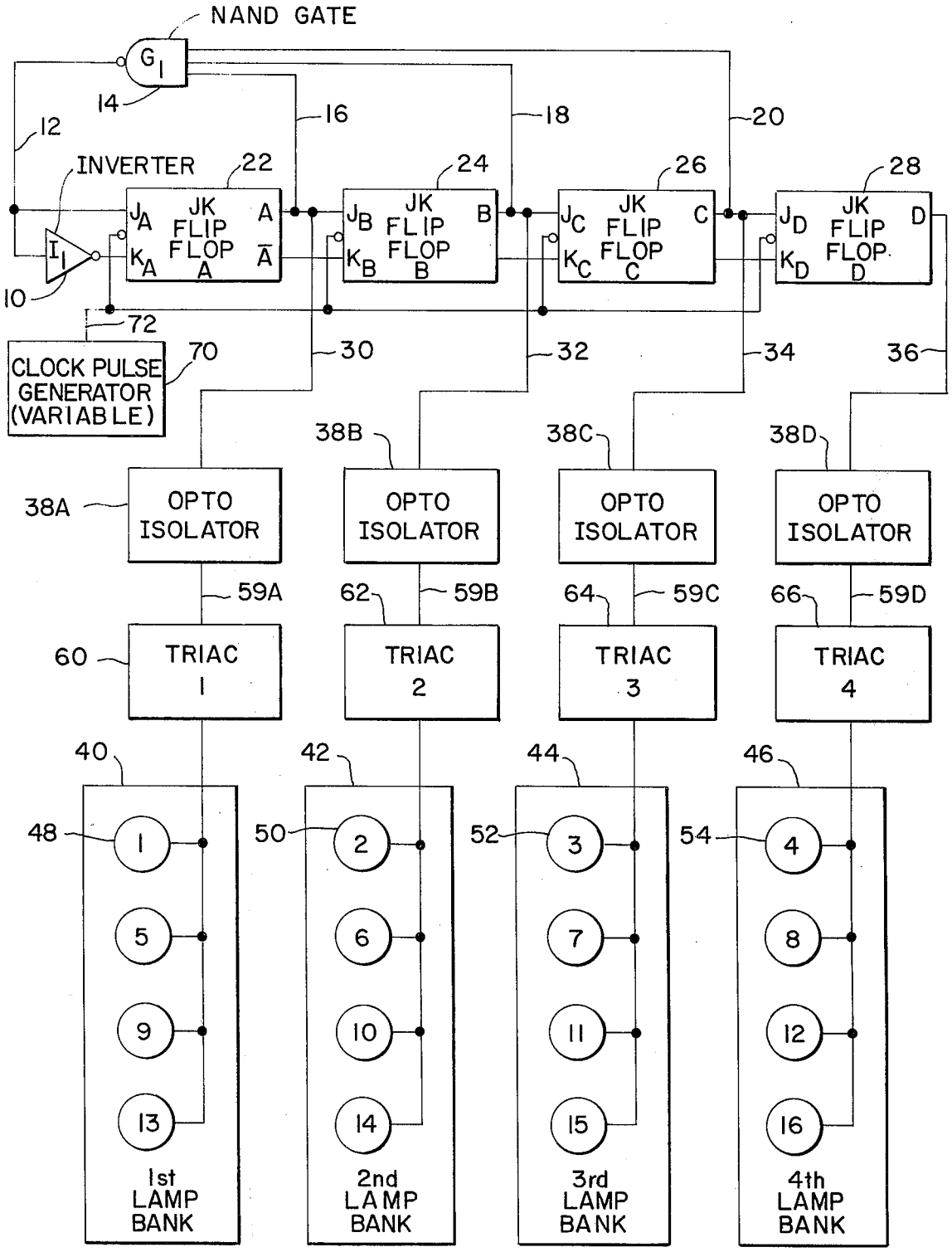
NAND GATE
G1
14
12
16
18
20
INVERTER
22
24
26
28
JK FLIP FLOP A
JK FLIP FLOP B
JK FLIP FLOP C
JK FLIP FLOP D
JA
KA
A
Ā
JB
KB
B
JC
KC
C
JD
KD
D
I1
10
72
CLOCK PULSE GENERATOR (VARIABLE)
70
30
32
34
36
38A
38B
38C
38D
OPTO ISOLATOR
OPTO ISOLATOR
OPTO ISOLATOR
OPTO ISOLATOR
59A
62
59B
64
59C
66
59D
60
TRIAC 1
TRIAC 2
TRIAC 3
TRIAC 4
40
42
44
46
48
50
52
54
1
5
9
13
2
6
10
14
3
7
11
15
4
8
12
16
1st LAMP BANK
2nd LAMP BANK
3rd LAMP BANK
4th LAMP BANK

BORDER FLASHERS

This invention relates to improvements in flashing devices for sequentially actuating lamps, lamp banks and the like.

An object of the invention is to provide a novel and improved flasher device for lamps, lamp banks and the like, in which the switching is carried on without the use of electro-mechanical switches and similar means.

Another object of the invention is to provide a novel and improved border lamp flasher device which includes commercially available integrated logic circuits to the manufacture of a device of this type.

A further object of the invention is to provide a novel and improved border lamp flasher device employing eletronic circuitry by which lamps are switched in such a way as to make it appear as if the lamps are circulating around the border of a sign, marquee or the like, so that it may be used as an attention-getter in displays, and also on signs, theater marquees and other devices.

Still another object of the invention is to provide a novel and improved lamp flasher device of the type described, which achieves the desired visual effect using only solid state circuits of the sub-miniature integrated circuit type, which are becoming increasingly inexpensive as mass production and ultimate industrial use increases.

Still a further object of the invention is to provide a novel and improved lamp flasher device which employs J-K Flip-Flops in the ring counter configuration, and additional logic circuitry is added to insure that the J-K Flip-Flops are energized in the desired sequence, and in which the outputs of the J-K Flip-Flops are fed to silicon controlled rectifiers, known as "Triacs," and so that these control the lamps in the various lamp banks, and so that when a flip-flop is energized, a corresponding lamp or bank of lamps is energized to give the desired apparently moving effect.

Still another object of the invention is to provide a novel and improved lamp flashing and controlling device of the type described, and which is simple in design, does not use moving electro-mechanical parts and hence avoids sparking and flashing, and which can be made at relatively low cost and by mass production methods.

The above and other objects and advantages of the invention will become apparent from the following description of a preferred embodiment thereof, as illustrated in the accompanying drawings, forming a part hereof.

In the drawings:

FIG. 1 is a schematic and block diagram of the lamp flashing and controlling device in relation to several banks of lamps.

In connection with the manufacture and use of illuminated electric signs, it was customary for many years commencing about the year 1910 to employ rotary sequence switching for controlling the turning on and off of the various lamps, and lamp banks on the sign itself and its border, so that a running or circulating effect was produced by this means. However, such rotary switches produced sparking and flashing, which at that time, until the "late thirties" did not matter very much, so long as the desired visual effects were produced. Even with the advent of increased use of Radio in the "Thirties" this did not matter very much. However, with the mass introduction of Television in the late 1940's and thereafter, such sparking from the electro-mechanical switching on signs did produce a source of interference with the received television signal.

The present invention seeks to provide a means for producing a lamp flashing and border movable lamp controlling device not using electro-mechanical switching means at all, but rather means having no moving parts.

In order to understand clearly the nature of the invention and the best means for carrying it out, reference may be had to the drawings, in which like numerals denote similar parts throughout.

As shown, there is an invertor 10 connected by wire 12 to a NAND gate 14, having output wires 16, 18 and 20 connected to terminals as shown of first J-K flip-flop 22, second J-K flip-flop 24, third J-K flip-flop 26, and fourth J-K flip-flop 28. The outputs of the flip-flops 22, 24, 26 and 28 are connected by wires 30, 32, 34 and 36 respectively, through opto-isolators 38A, 38B, 38C and 38D, otherwise known as "PHOTON COUPLERS" for providing coupling and decoupling.

In FIG. 1, it is seen that there are for example four separate banks of lamps 40, 42, 44 and 46, each bank containing for example four lamps 48, 50, 52 and 54, connected in parallel in each bank to their respective wires 30, 32, 34 and 36, and their respective series opto-isolators such as 38A, it being seen that there are introduced into the circuits between the opto-isolators and the lamps, by wires 59A, 59B, 59C and 59D the silicon-controlled rectifiers 60, 62, 64 and 66, also known in the art as "TRIACS" since there is a third wire connected in addition to the normal two wires for a rectifier.

As shown in the drawing, there is also a variable clock pulse generator 70 which is connected by wires 72 to the inputs of all four of the flip-flops 22, 24, 26 and 28. The invention thus employs J-K Flip-Flops 22 to 28 in the ring counter configuration, and additional logic circuitry is added to ensure that the J-K FLIP-FLOPS are energized in the desired sequence to control the lighting and unlighting of the lamps in the banks 40, 42, 44 and 46.

The outputs of the J-K Flip-Flops are fed to silicon controlled rectifiers 60, 62, 64 and 66, called "TRIACS" and these control the lamps. Hence when a flip-flop is energized, a corresponding lamp or lamp bank of lamps is energized. An OPTO-Isolator (photon coupler) 38A, etc. provides decoupling.

For example, suppose we wish to have a 16 lamp display as shown in the four banks in the lower portion of FIG. 1, with every three lamp banks lit and the fourth lamp bank such as 46 unlit, and lamps continuously moving, that is extinguishing each successive lamp at a fixed rate. Hence we have four banks of four lamps each, 40, 42, 44 and 46, controlled by four master J-K flip-flops 22, 24, 26 and 28, and the rate of movement is controlled by a master clock pulse generator 70 of conventional usual design.

The drawing shows how the circuit would be constructed. The circuit will operate as follows: When power is switched on, the four flip-flops will be randomly energized. After four clock pulses, 22, 24 and 26 will be energized and 28 de-energized. Hence lamps in bank 54 will be the only lamps which are out, of the total of 16 lamps in the other three banks of four lamps each. On the next clock pulse flip-flop 22 will be de-energized and lamps in the bank 40, will be out, while flip-flops 24, 26 and 28 are energized and the lamps in banks 42, 44 and r6 will be on. On the next clock pulse flip-flops 22, 26 and 28 are set and 24 is re-set, turning off the lamps in bank 42, and so on. From then on, the process is repeated as explained.

Although the invention has been described in specific terms, it is understood that various changes may be made in size, shape, materials and arrangement without departing from the spirit and scope of the invention as claimed.

Having herein described the invention, what is claimed as new is:

1. A source of electric power, lamp means for connection to said source of electric power for being energized thereby to produce illumination, major electric and electric switch means connected to said source of electric power and said lamp means for controlling the flow of current to said lamp means, electronic gate means for blocking said current flow, and illumination control and regulating means connected to said lamp means and said major switch means for controlling the turning on and off of said lamp means, timed pulse generating means, said control and regulating means being constructed and arranged for predetermining the timing and duration of said periods of turning on and off of said lamp means.

2. The construction of claim 1, and wherein said lamp means comprises a plurality of discrete banks of lamps, said major switch means being constructed and arranged for conducting any portion and the intirity of said current to said lamps according to a predetermined pulsed timing pattern.

3. The construction of claim 1 and wherein said lamp means comprises a plurality of discrete banks of individual lamps, with a plurality of lamps connected in each of said banks of lamps, and wherein said illumination control and regulating means and said electronic gate means is interposed in said major switch means for selectively turning on and off any of said banks of individual lamps.

4. The construction of claim 3, and comprising said clock pulse generator means interposed in said circuit intermediate said source of electric power and said lamp means for generating timed pulses in said circuit, and NAND electronic gate means for selectively blocking current flow to any said lamp means.

5. The construction of claim 4, and comprising a plurality of discrete flip-flop circuit means connected to said clock pulse generator means, and opto-circuit isolator photon coupler and decoupler means interposed in each of said flip-flop circuit means for selectively blocking energization of said portion of said lamp means during a predetermined time cycle period, while retaining unblocked the remaining lamp means for illumination during said cycle period.

6. The construction of claim 5, and comprising a plurality of silicon-controlled rectifier means connected as TRIACS between said opto-circuit isolator means and said lamp means for predetermined regulated lamp current cut-off to give a rolling border illumination effect, with only one lamp bank at a time being cut off, said NAND electronic gate means being connected to each said silicon-controlled rectifier means for controlling current flow to said lamp means.

* * * * *